United States Patent [19]

Zitser et al.

[11] 4,241,779

[45] Dec. 30, 1980

[54] APPARATUS FOR MANUFACTURING FOUNDRY CORES

[76] Inventors: Vitaly A. Zitser, ulitsa Pervomaiskaya, 9/4, kv. 17, Dolgoprudny Moskovskoi oblasti; Alexandr V. Melnikov, ulitsa Dorozhnaya, 7, korpus 1, kv. 138, Moscow; Leonid V. Bachelis, Schelkovskoe shosse, 91, korpus 2, kv. 221, Moscow; Jury E. Morozov, Leninsky prospekt, 39/1, kv. 264, Moscow; Vladimir A. Ivanov, ulitsa Rustaveli, 3, korpus 6, kv. 34, Moscow; Zinaida A. Abramova, Kronshtadtsky bulvar, 57, kv. 110, Moscow, all of U.S.S.R.

[21] Appl. No.: 64,508

[22] Filed: Aug. 7, 1979

[51] Int. Cl.[3] ..... B22C 13/12

[52] U.S. Cl. ..... 164/207; 164/186; 164/228; 164/386

[58] Field of Search ..... 164/207, 200–202, 164/342, 385, 386, 210–213, 167–169, 228, 180, 181, 186, 159, 165, 166, 18, 19, 23, 37, 28

[56] References Cited

U.S. PATENT DOCUMENTS 3,802,484 4/1974 Ovodov et al. ..... 164/228

*Primary Examiner*—Robert D. Baldwin
*Assistant Examiner*—K. Y. Lin
*Attorney, Agent, or Firm*—Fleit & Jacobson

[57] ABSTRACT

A feature of the present invention is that an apparatus for manufacturing foundry cores is provided with a device for fastening together halves of core boxes, located before a heating chamber, and with a device for unfastening the halves of the core boxes, arranged behind the heating chamber, each of the core boxes comprising two horizontal rods with conical elements placed in the bottom half thereof and cooperating with the above devices for fastening and unfastening the core boxes, and two vertical rods secured to the top half of the core boxes and having at their bottom ends slots and conical orifices cooperating with the conical elements of the horizontal rods.

2 Claims, 6 Drawing Figures

APPARATUS FOR MANUFACTURING FOUNDRY CORES

BACKGROUND OF THE INVENTION

1. Field of the Invention

The invention relates to foundry and more particularly to equipment for manufacturing foundry cores in a heated tooling.

The invention can be employed at automotive, sanitary engineering, electrical engineering, machine building and other industrial production works inherent to which is a large-lot and mass character of production.

2. Description of the Prior Art

In recent years, methods for manufacturing foundry cores directly in core boxes have found extensive application in world practice, these being the so-called "hot-box" and "cold-box" processes.

The "hot-box" process provides for the manufacture of cores by blowing a core sand composed of sand, a binder and a catalyst into a heated core box. The core sand hardens under the action of heat and of the catalyst through a rapid polymerization of the binder. Foundry machine building works manufacture a range of multi-station apparatus operating on the "hot-box" principle. The apparatus includes a core-blowing machine, devices for disassembling core boxes and delivering finished cores, a device for heating the core boxes and a transportation means for moving the core boxes from one station to another.

The apparatus operates as follows.

In the first station, a hot box is pressed against a sand-blowing plate and filled with sand. The second station is intended for inspecting and changing the core boxes. Next, the sand hardens in several stations, as the core boxes are heated by either passing them through a heating chamber or energizing heaters built into them. In the last station, the core boxes are opened and, after a finished core is removed, blown with compressed air.

The "cold-box" process provides for the manufacture of cores by blowing a cold core box with sand and a subsequent hardening thereof either through blowing by a gaseous catalyst (Ashland cold-box process) or the use of a highly reactive binder with a greater amount of catalyst (Fascold or Gisag cold-box process).

Equipment for manufacturing foundry cores on the "cold-box" principle has become widely known.

Overall, the equipment operating on the "hot-box" and "cold-box" principles, while enhancing efficiency, increasing strength of sand and improving working conditions, fails to provide an effective ventilation of cores, in particular, such as cores for heating boilers and radiators which are cast with metal on all sides and, except for two small core prints, are out of contact with a mould. As sand hardens uniformly throughout the cross section, vents in cores are obtained and communicated with the atmosphere by manufacturing cores of two halves which are glued together. These additional process operations substantially complicate the manufacture of cores, raise labour requirements, prejudice geometric and dimensional accuracies of cores, hinder a complex automation of core manufacture.

There are known a method and an apparatus for carrying the method into effect which are free of the above shortcoming (see FRG Pat. No. 2,239,057, cl. B 22 C 9/10).

The method consists in that a fluid sand is pressed into a heated core box, the core box is sealed tight, then, after a specified holding necessary to harden the sand, a finished core is removed.

The method enables any cores to be fabricated in a single piece, as a natural canal or porosity is formed in the middle of the core in the course of hardening through which gases can be effectively vented. The apparatus is composed of capacities and batchers of starting sand components, a mixer with a gate shutting off a discharge port, a pressing cylinder with a ram, a batching chamber, a sliding damper with an expansible nozzle, a lifting table, and operates in the manner below.

Starting components of the sand are fed into the mixer, stirred therein, moving in the process toward the discharge port, where a finished fluid sand is formed and transferred into the batching chamber having the damper in its bottom part. Once the batching chamber is filled with sand, the gate closes the discharge port of the mixer, the damper slides to align the nozzle with the batching chamber, while the table lifts and forces a heated core box against the nozzle. The ram is acted upon by a pressing cylinder to pack sand into the core box. Once this is completed, the core box is sealed to prevent sand from being ejected through the inlet opening. After a certain time necessary for the foam to abate and the sand to lose mobility, the core box can be transferred to a next station. The damper closes again the bottom of the batching chamber, the ram returns to initial position, and the gate opens the discharge port of the mixer. The cycle is then repeated.

The pressure in the core box may rise under a certain set of conditions and attain a value sufficient for overcoming the weight of the top half of the core box. Therefore, if a core box, after it has been packed and sealed, is held at the pressing position for a certain period of time, the top half thereof will be forced up, and some sand will be spilled out along the parting plane, this unavoidable resulting in a defective core.

Sand hardening requires much more time as compared to the "hot-box" and the "cold-box" processes, since hardening takes place mainly through vaporization of moisture from the fluid sand.

The prolonged holding of the core after sand is pressed and the greater sand hardening time lead to a substantially longer core manufacturing cycle and thus appreciably lower both the efficiency of the machine as compared to equipment operating on the "hot-box" and the "cold-box" principles and, therefore, the advantages the machine may offer in large-lot and mass production runs.

A material disadvantage of the known machine is that it lacks in devices permanently fastening together the halves of a core box from the moment it is packed to the moment it is opened. A fairly long holding of a core box compressed between the table and the pressing mechanism, once the sand has been packed, necessary to allow the sand pressure in the core box to fall off sufficiently and so prevent the top of the core box from being lifted once the core box is set free, brings down the efficiency fo the multi-station machine, and in the final analysis, provides no absolute guarantee that the top half of the core box will not be dislodged vertically by the residual pressure. A result of these movements may be a distortion of geometric dimensions of cores and a poorer quality thereof.

SUMMARY OF THE INVENTION

It is therefore an object of the invention to provide an apparatus for manufacturing foundry cores of high both dimensional and geometric accuracies.

Another object of the invention is to provide an apparatus designed to ensure a reliable fastening of halves of the core box from the moment of time preceding pressing of sand to the moment of time of disassembly and to eliminate movements of the top half of the core box in the vertical plane.

Still another object of the invention is to increase the efficiency of the apparatus.

The above and other objects are attained in an apparatus for manufacturing foundry cores, comprising a supporting frame formed with two tiers, the bottom tier carrying a transportation means and transfer tables, and the top one, sand preparation and pressing mechanisms, a pusher with a crosspiece, a heating chamber and mechanisms for disassembling the core boxes and delivering a finished core, provided, according to the invention, with a device for fastening together halves of the core boxes, located before the heating chamber, and a device mounted behind the heating chamber and intended for unfastening the halves of the core boxes, each of the core boxes containing two horizontal rods with conical elements, placed in the bottom half of the core boxes and cooperating with the above devices for fastening and unfastening the core boxes, and two vertical rods secured to the top half of the core boxes and having at their bottom ends slots and conical orifices intended for cooperating with the conical elements of the horizontal rods.

It is advisable to have the device for fastening the halves of the core boxes built as horizontal piston actuators hinged to the pusher crosspiece, and the device for unfastening the halves of the core boxes, as a bracket with adjustable stops, mounted on the mechanism for disassembling the core boxes.

According to the invention, the transfer table lifts a heated core box from the transportation means and delivers it to the pressing mechanism. The devices for fastening the halves of the core box act upon the horizontal rods thereof in a manner that the conical elements of the horizontal rods enter the conical orifices of the vertical rods. This results in their wedging so that both halves of the core box are reliably fastened. This operation eliminates the need for holding the halves of the core boxes together after pressing and substantially reduces the cycle of operation of the apparatus. The devices for fastening the halves of the core box are hinged to the pusher crosspiece, this preventing accidents should the mobile elements fail to return to initial position. The pressing mechanism packs sand prepared by the sand preparation mechanism, into the core box, the core box is sealed and directly transferred by the pusher to the heating chamber which holds a number of other core boxes. As soon as a first core box is pushed into the heating chamber, the last core box is discharged into the zone of action of a mechanism for delivering a finished core which pulls the core box over to the transfer table. At the end of stroke, the horizontal rods of the core box meet the adjustable stops of the brackets mounted on the mechanism for disassembling the core boxes, and the core boxes are returned to initial position. This gives rise to a wedging action which unfastens the halves of the core box. The conical elements of the horizontal rods are moved out of the conical orifices of the vertical rods, and, simultaneously, the core box is unsealed. In this manner, the movement of the core box upon the transfer table is put to good advantage, fulfilling two additional operations, the necessary length of movement being determined by the adjustable stops provided on the mechanism for disassembling the core boxes which opens the core box, whereas the vertical rods are disengaged from the horizontal rods owing to the provision of slots.

Once the core is removed, the core box is re-assembled by the mechanism for disassembling the core boxes and lowered by the transfer table upon the transportation means which returns the core box to the pressing mechanism station.

The multi-station apparatus is built of two tiers, so as to minimize the width thereof and facilitate its sitting on existing floorspace. The apparatus roughly doubles the manufacturing capacity and stabilizes the quality of cores. It should be emphasized that a reliable fastening of the halves of the core box from the moment of time a fluid sand is packed therein to the moment of time the core box is disassembled substantially reduces the pollution of the mechanism and makes the core manufacturing process cleaner.

BRIEF DESCRIPTION OF THE DRAWINGS

These and other objects and features of the invention become readily apparent from embodiments thereof which will now be described by way of example with reference to the accompanying drawings, in which.

DESCRIPTION OF THE PREFERRED EMBODIMENT

Figure 1:
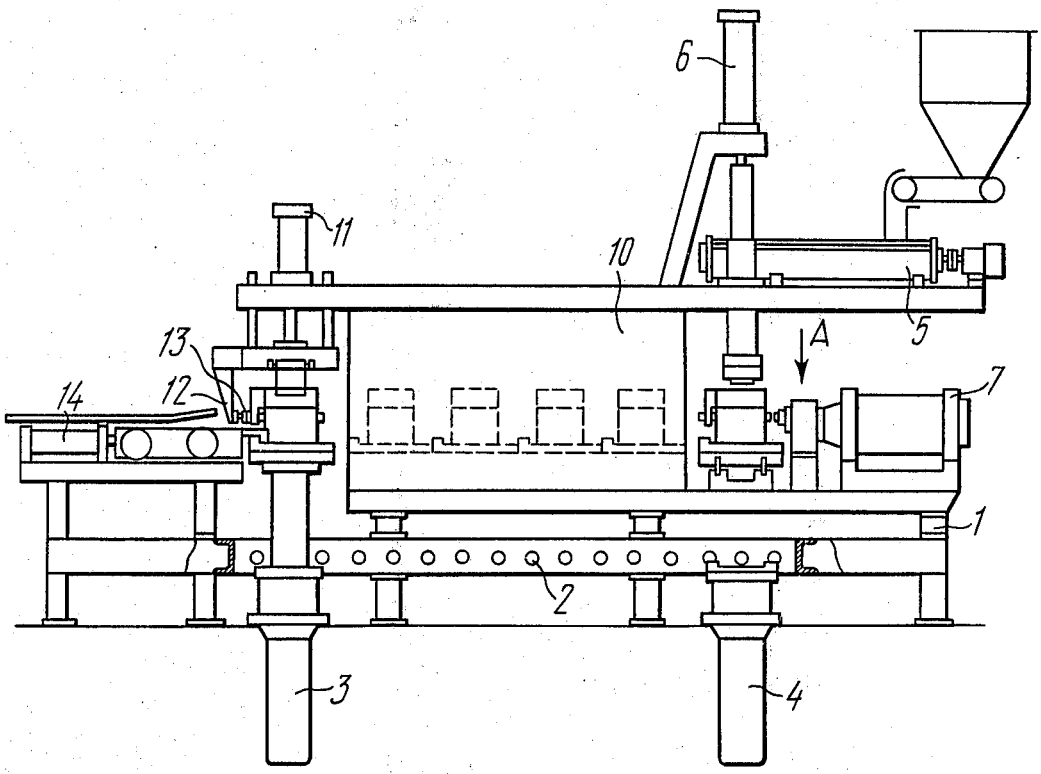
FIG. 1 is a general view of the apparatus for manufacturing foundry cores.
Figure 2:
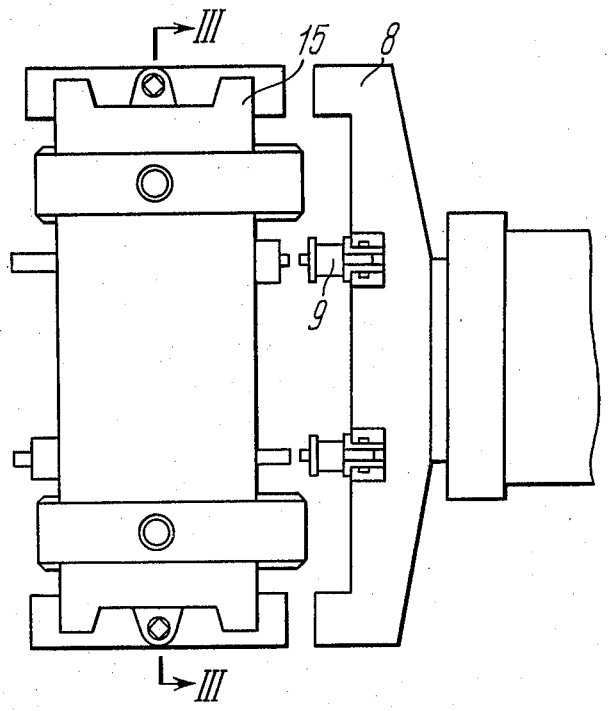
FIG. 2 is a view along arrow "A" on FIG. 1.
Figure 3:
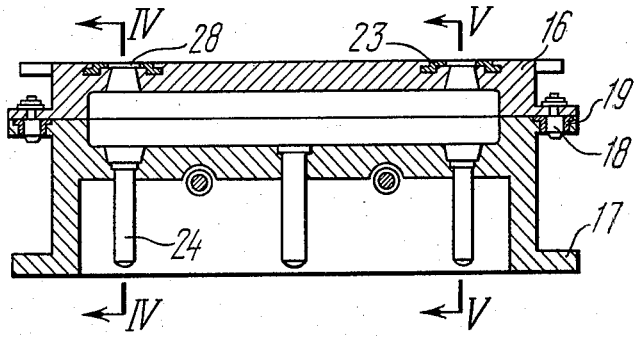
FIG. 3 is a section through III—III on FIG. 2.
Figure 4:
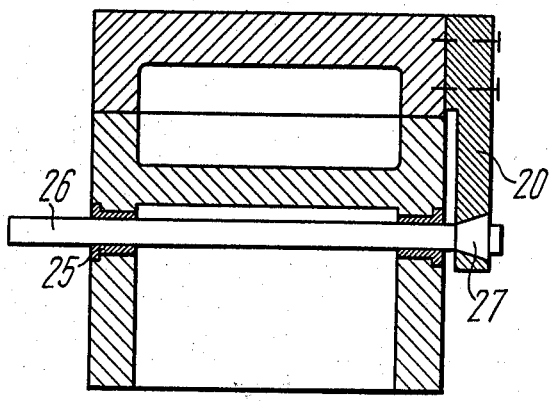
FIG. 4 is a section through IV—IV on FIG. 3.
Figure 6:
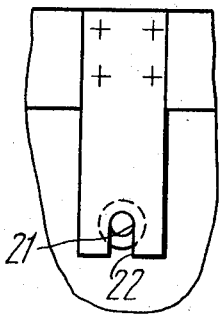
FIG. 6 is a view along arrow "B" on FIG. 5.
Figure 5:
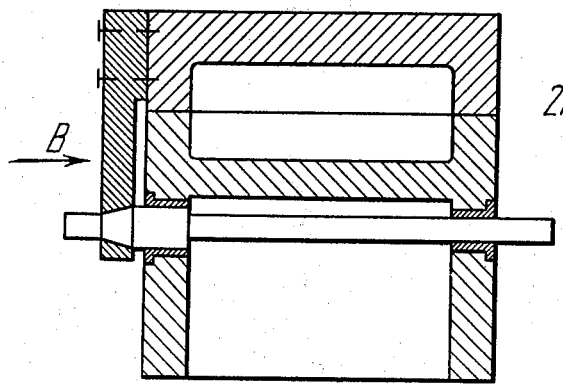
FIG. 5 is a section through V—V on FIG. 3.

An apparatus for manufacturing foundry cores (FIGS. 1 through 6) includes a supporting frame 1 with two tiers, the bottom one carrying a transportation means 2 and transfer tables 3 and 4, and the top one, a sand preparation mechanism 5, a pressing mechanism 6, a pusher 7 with a crosspiece 8 having piston actuators 9 hinged thereto, a heating chamber 10, a mechanism 11 for disassembling core boxes with brackets 12 and adjustable stops 13 and a mechanism 14 for delivering finished cores.

A core box 15 contains a top 16 and a bottom 17 halves locked one to another by pins 18 and bushings 19. The top half 16 carries on diagonally opposite sides vertical rods 20 with conical orifices 21 and slots 22 and built-in gates 23 serving to seal the core box 15. The bottom half 17 incorporates ejectors 24 and bushings 25 intended as guides for horizontal rods 26 with conical elements 27. Sand is charged into the core box through inlet orifices 28. The apparatus operates as follows.

The transfer table 4 lifts the core box 15 from the transportation means 2 and delivers it to the pressing mechanism 6. The piston actuators 9 move the horizontal rods 26 of the core box 15 inside the bushings 25 so as to engage the conical elements 27 of the horizontal rods 26 into the conical orifices 21 of the vertical rods 20. This produces a wedging effect which locks together the halves of the core box 15. The pressing mechanism 6 packs sand through the inlet orifices 28, supplied by the sand preparation mechanism 5. The gates 23 are moved to close the orifices 28, and the core box is sealed and directed by the pusher 7 into the heating chamber 10 which accommodates several other core boxes. As a fresh core box is charged into the heating chamber, a last core box is discharged therefrom into the zone of action of the mechanism 14 for delivering finished cores. The mechanism 14 pulls the core box from the heating chamber 10 onto the transfer table 3 which is then in the top position. At the end of a stroke, the horizontal rods 26 meet the adjustable stops 13 of the mechanism 11 for disassembling core boxes and are guided by bushings 25 into initial position. This produces a wedging effect which opens the halves of the core box. The conical elements 27 of the horizontal rods 26 are moved out of the conical orifices 21 of the vertical rods 20. Simultaneously, the core box is unsealed, and the gates 23 thereof return to initial position.

The mechanism 11 for disassembling core boxes opens the core box, and the vertical rods 20 disengage themselves from the horizontal rods 26 owing to the slots 22. Once a core is pushed out by the ejectors 24 and removed from the core box, the core box is reassembled and lowered by the transfer table 3 upon the transportation means 2 which moves it toward the transfer table 4. Another cycle of operation of the apparatus starts when the transfer table 4 moves upwards together with the core box.

The apparatus according to the invention provides a roughly double efficiency as compared to existing core-making machines, while retaining high both dimensional and geometric accuracies of cores.

What is claimed is:

1. An apparatus for manufacturing foundry cores by pressing a fluid sand into heated core boxes, comprising:

a tiered supporting frame; a transportation means and transfer tables mounted on a bottom tier of said supporting frame; a sand preparation and a pressing mechanism and a pusher with a crosspiece, mounted on an upper tier of said supporting frame; a heating chamber for receiving core boxes pushed by said pusher; a set of core boxes; a device for fastening halves of the core boxes, located before said heating chamber; a device for unfastening the halves of the core boxes, mounted after said heating chamber; each of said core boxes having two horizontal rods with conical elements, located in the bottom half of the core boxes and cooperating with said devices for fastening and unfastening the halves of the said core boxes, and two vertical rods mounted on the top half of said core boxes, having at the bottom ends thereof slots and conical orifices for cooperating with the conical elements of the horizontal rods; a mechanism for disassembling core boxes mounted after said heating chamber; and a mechanism for delivering finished cores, placed on an upper tier of said supporting frame.

2. An apparatus as claimed in claim 1, wherein the device for fastening the halves of the core boxes is formed with horizontal actuators hinged to the crosspiece of the pusher, whereas the device for unfastening the halves of the core boxes is built as brackets with adjustable stops, mounted on the mechanism for disassembling the core boxes.

* * * * *